US010060239B2

(12) United States Patent
To

(10) Patent No.: US 10,060,239 B2
(45) Date of Patent: Aug. 28, 2018

(54) HOT WATER INJECTION STIMULATION METHOD FOR CHOPS WELLS

(71) Applicant: Husky Oil Operations Limited, Calgary (CA)

(72) Inventor: Kevin Kar Wan To, Calgary (CA)

(73) Assignee: Husky Oil Operations Limited, Calgary (CA)

( * ) Notice: Subject to any disclaimer, the term of this patent is extended or adjusted under 35 U.S.C. 154(b) by 0 days.

(21) Appl. No.: 15/380,182

(22) Filed: Dec. 15, 2016

(65) Prior Publication Data

US 2017/0175504 A1 Jun. 22, 2017

Related U.S. Application Data

(60) Provisional application No. 62/269,182, filed on Dec. 18, 2015.

(51) Int. Cl.
*E21B 43/24* (2006.01)
*E21B 36/00* (2006.01)
*E21B 43/25* (2006.01)

(52) U.S. Cl.
CPC ..... *E21B 43/24* (2013.01); *E21B 36/006* (2013.01); *E21B 43/25* (2013.01)

(58) Field of Classification Search
None
See application file for complete search history.

(56) References Cited

U.S. PATENT DOCUMENTS 3,707,189 A * 12/1972 Prats ..... E21B 43/24 166/272.3
3,882,941 A * 5/1975 Pelofsky ..... E21B 43/18 166/263
4,130,163 A * 12/1978 Bombardieri ..... E21B 43/18 166/252.1
2007/0017677 A1* 1/2007 Steele ..... E21B 43/2406 166/303
2010/0218954 A1* 9/2010 Yale ..... E21B 43/24 166/369

* cited by examiner

*Primary Examiner* — Anuradha Ahuja
(74) *Attorney, Agent, or Firm* — Frost Brown Todd LLC

(57) ABSTRACT

A method for stimulating heavy oil recovery from CHOPS wells at or nearing the end of productive life but not experiencing water-out, wherein produced water is heated to below boiling point and injected back downhole to reduce heavy oil viscosity in the near-wellbore region and surrounding the wormhole network, enabling existing reservoir pressure to drive the reduced-viscosity heavy oil toward the well for production to surface. The injection-soak-production cycle can be repeated as desired so long as adequate reservoir pressure exists.

44 Claims, 2 Drawing Sheets

HOT WATER INJECTION STIMULATION METHOD FOR CHOPS WELLS

CROSS REFERENCE TO RELATED APPLICATIONS

This application claims the benefit of and priority to U.S. Provisional Application Ser. No. 62/269,182, filed Dec. 18, 2015, incorporated herein in its entirety for all purposes.

FIELD OF THE INVENTION

The present invention relates to hydrocarbon recovery methods, and more specifically to heavy oil recovery techniques and stimulation methods.

BACKGROUND OF THE INVENTION

There are certain heavy hydrocarbon deposits, particularly but not exclusively located in the Provinces of Alberta and Saskatchewan in Canada, that are classified as "heavy oil" deposits. While various definitions are commonly in use within the hydrocarbon exploration and production industry, heavy oil is conventionally defined as liquid and semi-solid hydrocarbon that is less than 20 degrees API gravity, or more than 100 cP viscosity at reservoir conditions.

Heavy oil is commonly found in high-porosity, unconsolidated sandstones. The combination of relatively high viscosity and an unconsolidated reservoir has presented challenges for recovery efforts. One recovery method that has been commercially implemented is called Cold Heavy Oil Production with Sand, or "CHOPS". In a CHOPS hydrocarbon recovery system, a well is drilled to the target reservoir (the well cased, cemented and perforated) and the heavy oil plus sand flows to the well by existing natural reservoir pressure, and the heavy oil plus sand is produced to surface (generally using progressing cavity pumps) where the components are separated. In addition to heavy oil and sand, other materials such as waste fluids are produced, including chloride-rich water. After separation of the various components, the heavy oil is transported to a facility for upgrading and refining of hydrocarbon products, and the sand and fluid waste is transported for disposal. Due to the sand production, a network of small channels known as "wormholes" is generated, presenting high-permeability passageways for recovery.

While it has been found that production of sand with the heavy oil results in improved recovery over methods seeking to screen or otherwise block sand production, recovery rates are conventionally still relatively low (on the order of 6 to 12% with an average of around 8%). Also, CHOPS is a primary recovery method relying on existing reservoir pressure, and so the heavy hydrocarbon requires significant pressure to drive the viscous material to the well for pumping to surface. Primary CHOPS recovery wells therefore generally come to end-of-life when the viscosity of the resource overcomes the local pressure regime. While some enhanced oil recovery ("EOR") methods have been proposed to extend the life of CHOPS wells, there has been little success in achieving results much beyond what is possible through primary production.

One well-known EOR method used with heavy oil and bitumen deposits is Cyclic Steam Stimulation or "CSS". In a CSS hydrocarbon recovery operation, high-temperature steam is injected downhole to the heavy oil or bitumen-containing formation. The steam is generated at 120-240 degrees C. or higher to impart maximum heat transfer to the reservoir. After steam injection the well is shut in, allowing the steam to "soak" in the target formation and increase the hydrocarbon mobility through reduced viscosity. The mobilized hydrocarbon can then flow more readily to the well. The well is then opened again and put into production mode (rather than injection mode) and the hydrocarbon is produced to surface. The injection-soak-production cycle is repeated as many times as are appropriate and warranted given the reservoir and the economic constraints. However, the use of CSS is generally not an option for CHOPS wells, as CHOPS well completion design will not tolerate these high temperatures and wellbore integrity would be a serious concern.

Another EOR technique proposed for heavy oil deposits is called the Hot Water Vapour Process or "HWVP". In an HWVP operation, hot water vapour is mixed with a gas (preferably a non-condensable gas) and the mixture is injected downhole. While the hot water vapour is not heated to the same temperatures as in CSS, the temperatures are still above desirable levels for a CHOPS well. To modify an HWVP operation to allow use with a CHOPS well would require high capital cost equipment such as vacuum insulated injection tubing and thermal injection packers, and a modified HWVP operation would thus be economically unreasonable for an end-of-life CHOPS well.

What is needed, therefore, is an economically sound method of well stimulation that can be used with end-of-life CHOPS wells while reducing the risk of casing/cement integrity failure.

SUMMARY OF THE INVENTION

The present invention therefore seeks to provide a method for heavy oil recovery from an end-of-life CHOPS well, where there has been no water-out. Produced water is heated and injected downhole to reduce the viscosity of the in situ heavy oil, to maintain temperatures within the heat tolerances of the casing and cement used in a CHOPS well. By reducing the viscosity in this way, the existing reservoir pressure—which was inadequate to drive the heavy oil to the well—may be sufficient to drive the reduced-viscosity heavy oil to the well for production.

According to a first broad aspect of the present invention, there is provided a method for recovering heavy oil from a CHOPS well, where the well has not experienced water-out, the method comprising the steps of:

a. producing water to surface;
b. heating the produced water to less than the boiling point of the produced water to form a heated water;
c. pumping the heated water down the well to the heavy oil;
d. shutting in the well and allowing heat from the heated water to reduce viscosity of the heavy oil;
e. allowing reservoir pressure to drive the reduced-viscosity heavy oil to the well; and
f. opening the well and producing the reduced-viscosity heavy oil to the surface.

According to a second broad aspect of the present invention, there is provided a method for stimulating heavy oil recovery from a CHOPS well that is experiencing reduced production due to heavy oil viscosity but not water-out, the method comprising the steps of:

a. producing water to surface;
b. heating the produced water to less than the boiling point of the produced water to form a heated water;
c. pumping the heated water down the well to the heavy oil;
d. shutting in the well and allowing heat from the heated water to reduce viscosity of the heavy oil;

e. allowing reservoir pressure to drive the reduced-viscosity heavy oil to the well; and
f. opening the well and producing the reduced-viscosity heavy oil to the surface.

According to a third broad aspect of the present invention, there is provided a method for recovering heavy oil from a CHOPS well, where the well has not experienced water-out, the method comprising the steps of:

a. producing water to surface;
b. heating the produced water to less than the boiling point of the produced water to form a heated water;
c. determining a volume of the heated water required to increase the heavy oil temperature by a desired amount to reduce viscosity;
d. pumping the volume of the heated water down the well to the heavy oil;
e. shutting in the well and allowing heat from the heated water to reduce viscosity of the heavy oil;
f. allowing reservoir pressure to drive the reduced-viscosity heavy oil to the well; and
g. opening the well and producing the reduced-viscosity heavy oil to the surface.

According to a fourth broad aspect of the present invention, there is provided a method for stimulating heavy oil recovery from a CHOPS well that is experiencing reduced production due to heavy oil viscosity but not water-out, the method comprising the steps of:

a. producing water to surface;
b. heating the produced water to less than the boiling point of the produced water to form a heated water;
c. determining a volume of the heated water required to increase the heavy oil temperature by a desired amount to reduce viscosity;
d. pumping the volume of the heated water down the well to the heavy oil;
e. shutting in the well and allowing heat from the heated water to reduce viscosity of the heavy oil;
f. allowing reservoir pressure to drive the reduced-viscosity heavy oil to the well; and
g. opening the well and producing the reduced-viscosity heavy oil to the surface.

A detailed description of exemplary embodiments of the present invention is given in the following. It is to be understood, however, that the invention is not to be construed as being limited to these embodiments. The exemplary embodiments are directed to a particular application of the present invention, while it will be clear to those skilled in the art that the present invention has applicability beyond the exemplary embodiments set forth herein.

BRIEF DESCRIPTION OF THE DRAWINGS

In the accompanying drawings, which illustrate exemplary embodiments of the present invention.

Figure 1:
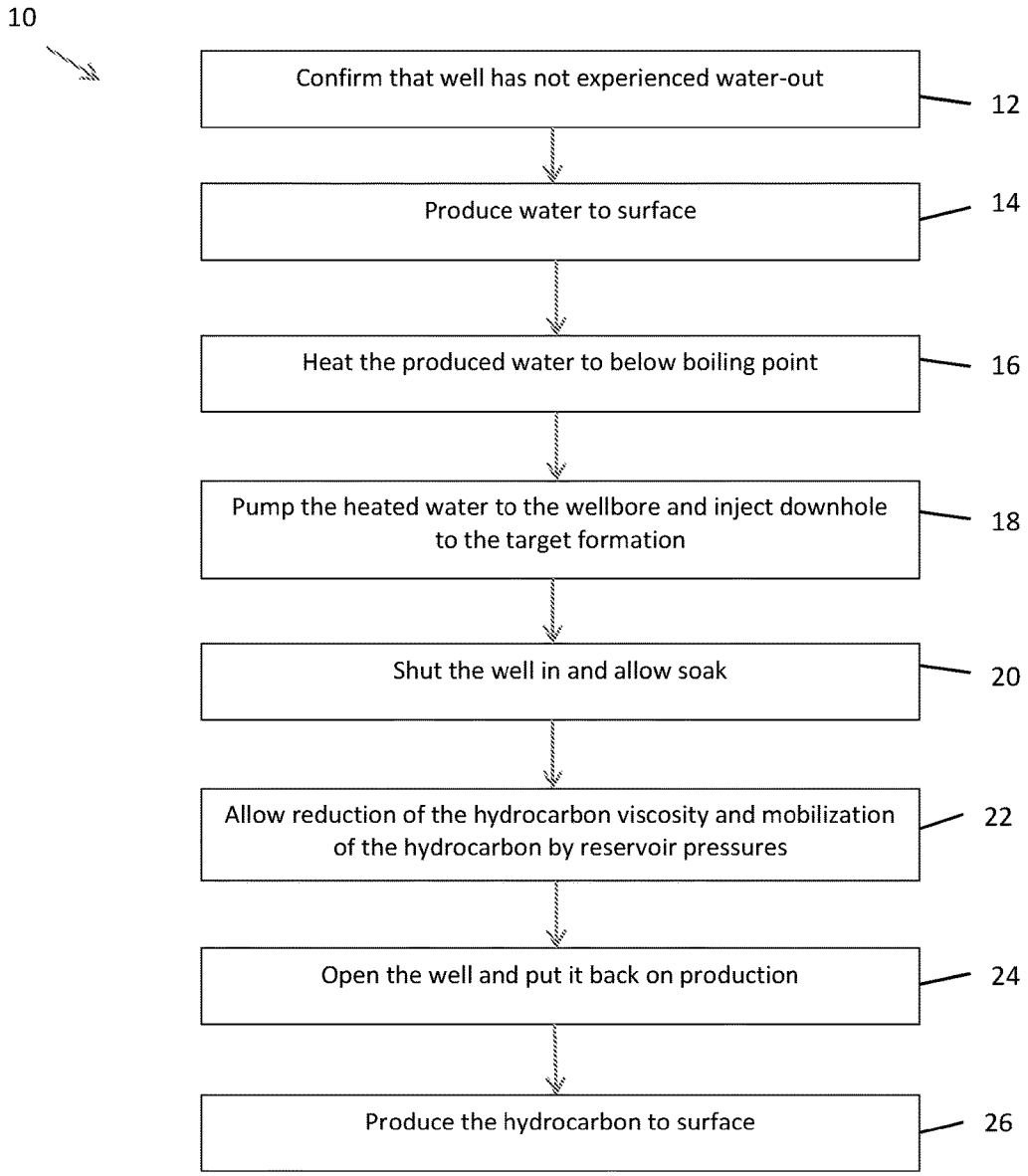
FIG. 1 is a flowchart illustrating a first exemplary method.

Exemplary embodiments of the present invention will now be described with reference to the accompanying drawings.

DETAILED DESCRIPTION OF EXEMPLARY EMBODIMENTS

Throughout the following description specific details are set forth in order to provide a more thorough understanding to persons skilled in the art. However, well known elements may not have been shown or described in detail to avoid unnecessarily obscuring the disclosure. The following description of examples of the technology is not intended to be exhaustive or to limit the invention to the precise form of any exemplary embodiment. Accordingly, the description and drawings are to be regarded in an illustrative, rather than a restrictive, sense.

The present invention is directed to methods and systems for introducing a limited amount of heat into a subsurface reservoir by means of heated but liquid water, in order to reduce viscosity of a target hydrocarbon and generate incremental recovery improvements. Specifically, the methods and systems are for use with CHOPS wells that are at or near end-of-life where there is still some remaining reservoir pressure but there is not a situation of water-out, and where steam-based methods cannot be employed, and injection-soak-production cycles are carried out in an attempt to achieve incremental improvements.

At end-of-life for a CHOPS well, wormholes may be present providing for high permeability channels into the reservoir from the wellbore. However, viscosity is a major impediment to natural flow from the formation to the wellbore for heavy hydrocarbon.

It is known in the art that increasing hydrocarbon temperature a small amount can significantly reduce viscosity, and thus enhance mobility. For example, the below table (from Ivory, J, et al., Handbook of Canadian Heavy Oil and Oil Sand Properties for Reservoir Simulation, Second Edition, Alberta Research Council, 2008, Chapter 3 Viscosity; citing McFarlane, R. and Bioletti, R., "Assessment of HYSYS for Estimating Oil Properties for In Situ Recovery," Alberta Research Council, 2002) illustrates that increasing temperature by only 20 degrees C. can have a substantial impact on the viscosity of a hydrocarbon.

| Temperature (° C.) | Viscosity (mPa · s) |
|---|---|
| 22.0 | 8350.0 |
| 40.0 | 1490.0 |
| 60.0 | 347.0 |

Source: McFarlane and Bioletti, 2002

The present invention involves the heating and injection of water into the CHOPS well that has been targeted for stimulation. This water is preferably produced water from one or more offset wells, which produced water is already a waste product and a cost item. The hot water that has been injected is then left to soak in the target well for a period of time, whereby the heat is transferred from the injected water, reducing the viscosity of the remaining oil in place and thereby allowing the remaining reservoir pressure to flow that oil to the wellbore where it can be produced. At the low temperatures that typical CHOPS wellbores can withstand (due to casing and cement heat tolerances), it is clear that there is a limit to how much oil can be mobilized per cubic meter of water injected for a specific water temperature, and thus methods and systems according to the present invention are preferably operated as a cyclical process whereby a well is put on repeated injection, soak and production cycles to achieve incremental oil production.

Turning to FIG. 1, a first exemplary method 10 is illustrated. The method 10 begins with step 12 in which the operator confirms that the CHOPS well has not experienced water-out. A water-out CHOPS well would have predominantly water in the near-wellbore region, and thus would likely not benefit from the present invention given that the near-wellbore water would act as a heat sink with a high specific heat capacity, taking heat from the injected water instead of allowing it to transfer to the hydrocarbon resource. Once the confirmation has been obtained, or even before or during confirmation, water is produced to surface at step 14 for use in the exemplary method. The water may be obtained from offset wells or even the CHOPS well itself, and in the situation where the water is obtained from the CHOPS well the water may come from the target formation or a different formation that well passes through. While it is possible to use fresh water, in most cases the use of produced water is the more favourable and economical option, and in some cases will be required due to regulatory constraints.

The produced water is heated at step 16 to a temperature below the boiling point of the produced water. While it is preferred to heat the water to just under the boiling point, or approximately 99 degrees C., it may be possible to heat the water to a slightly higher temperature if the water is being injected under pressure. The goal is to heat the produced water without the water entering the steam phase.

This heating may involve a single unit operation or a number of unit operations. For example, stimulation equipment may include a heater and pump. The produced water can be transported to the production tank of the CHOPS well and heated in the production tank using the fire tube, to approximately 40-50 degrees C., for example. The water could then be pumped from the production tank through the heater of the stimulation equipment, raising the temperature to near the boiling point on the way to the wellhead.

At step 18, the heated water is then injected down the tubing or well annulus and into the near-wellbore region in the target formation. The stimulation equipment is brought to site for the injection cycle and leaves the site when injection is complete; the well then returns to normal CHOPS production as the resultant temperature ranges are feasible for normal CHOPS production systems.

It is anticipated that some heat loss will occur between the outlet of the surface-based heating means and the subsurface sand face, such that the hot water entering the formation is at a lower temperature than the surface heating target temperature. While one reasonable estimate is a 40% heat loss between the outlet of the heater and the sand face, some heat will still be delivered to the reservoir without risking wellbore integrity as long as the water temperature is within the safe operating parameters of the casing and cement in the hole.

The well is then shut in at step 20 and allowed to soak. The length of the soak period will vary with the reservoir and heated water temperature, as would be obvious to one skilled in the art, but for one non-limiting example may be 10-14 days or possibly longer where appropriate.

At step 22 the heat from the heated water is allowed to move into the near-wellbore region of the reservoir (and through the wormhole network if one exists), reducing the viscosity of the hydrocarbon in the near-wellbore region. By reducing the viscosity, the heat renders the hydrocarbon more mobile and amenable to transport under ambient reservoir pressure conditions.

When it is determined that sufficient time has passed for the hydrocarbon to become mobilized, the well is opened at step 24 and put back on production. Production of the mobilized hydrocarbon to surface occurs at step 26.

As stated above, the present invention is intended to include repetition of the injection-soak-production cycle, and thus the above steps may be repeated until such time as the reservoir pressure is insufficient to enable economic recovery of the resource.

Figure 2:
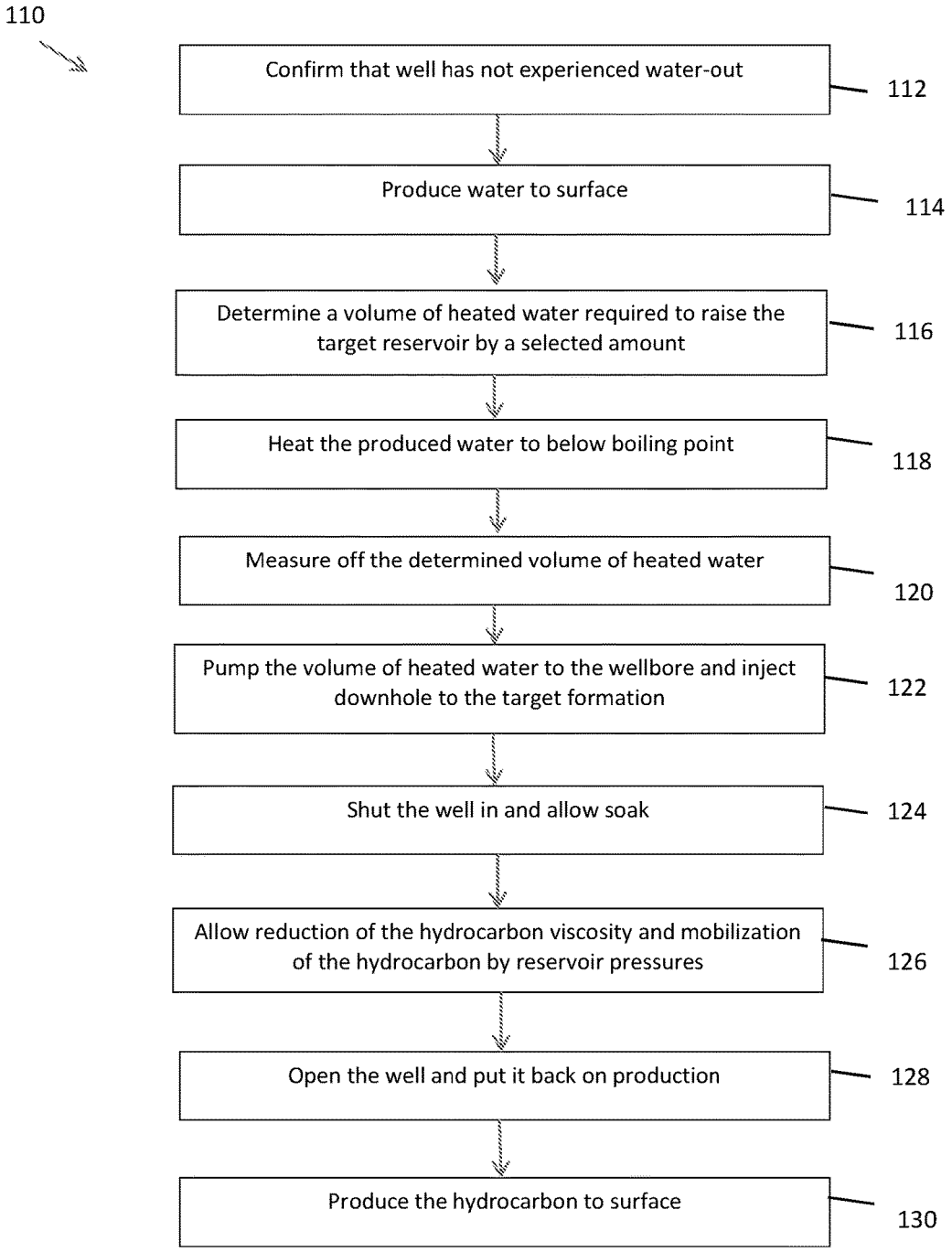
FIG. 2 is a flowchart illustrating a second exemplary method.

Turning now to FIG. 2, a second exemplary method 110 according to the present invention is illustrated. In the second method 110, a determination is made as to the specific volume of heated water necessary to heat the reservoir to achieve a desired viscosity reduction. As will be clear to those skilled in the art, the volume will depend on the reservoir characteristics, the nature and amount of the hydrocarbon, and the subsurface pressure environment, among other factors, and thus specific values or value ranges will not be set forth herein. If wormholes have had a chance to form before production declines, the presence of these pathways in the reservoir will also need to be taken into account in determining an adequate injected water volume. Absence of wormholes may thus require a lower water volume, but potentially more injection-soak-production cycles.

In the method 110, again there is confirmation at step 112 that the CHOPS well has not experienced water-out. Before, during or after such confirmation, water is produced to surface at step 114 for heating. At this point, unlike the first exemplary method 10, a determination is made at step 116 of the volume of heated water that will be required to elevate the reservoir temperature sufficiently to reduce the hydrocarbon viscosity level by a desired amount. The target viscosity reduction will depend in part on factors such as the starting viscosity and the downhole pressure environment, as the goal is to reduce the viscosity to a level sufficient to allow the natural pressure environment to move the hydrocarbon to the wellbore for production to surface. The water temperature that is safe for the particular CHOPS well may also impact the volume, as a lower temperature may require a greater volume of injected water. Selecting a target formation temperature increase may also provide a guide for this step 116.

The produced water is heated to the target temperature at step 118, and then a portion of that heated water is measured off at step 120 for injection. As will be clear, it may also be possible to measure off the produced water first and then heat that particular volume.

With the volume selected and measured off, the volume of heated water is then pumped downhole at step 122, and the well is shut down at step 124. The soak period continues during step 126, where the heat is transferred to the reservoir and allowed to reduce the hydrocarbon viscosity. The reduced-viscosity hydrocarbon is mobilized and can flow under reservoir pressure conditions to the wellbore, which may occur through the wormhole network or other permeability pathways.

After a predetermined period, the well is opened at step 128 and put back on production, and the mobilized reduced-viscosity hydrocarbon resource is produced to surface at step 130.

It should be noted that during the production phases, the injected water may also be produced to surface with the mobilized hydrocarbon, and may thus be recycled for later injection stages.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to".
- "connected", "coupled", or any variant thereof, means any connection or coupling, either direct or indirect, between two or more elements; the coupling or connection between the elements can be physical, logical, or a combination thereof.

"herein", "above", "below", and words of similar import, when used to describe this specification shall refer to this specification as a whole and not to any particular portions of this specification.

"or", in reference to a list of two or more items, covers all of the following interpretations of the word: any of the items in the list, all of the items in the list, and any combination of the items in the list.

the singular forms "a", "an" and "the" also include the meaning of any appropriate plural forms.

Words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description and any accompanying claims (where present) depend on the specific orientation of the apparatus described and illustrated. The subject matter described herein may assume various alternative orientations. Accordingly, these directional terms are not strictly defined and should not be interpreted narrowly.

Where a component (e.g. a circuit, module, assembly, device, etc.) is referred to herein, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Specific examples of methods and apparatus have been described herein for purposes of illustration. These are only examples. The technology provided herein can be applied to contexts other than the exemplary contexts described above. Many alterations, modifications, additions, omissions and permutations are possible within the practice of this invention. This invention includes variations on described embodiments that would be apparent to the skilled person, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

The foregoing is considered as illustrative only of the principles of the invention. The scope of the claims should not be limited by the exemplary embodiments set forth in the foregoing, but should be given the broadest interpretation consistent with the specification as a whole.

What is claimed is:

1. A method for recovering heavy oil from a Cold Heavy Oil production with Sand (CHOPS) well, where the well has not experienced water-out, the method comprising the steps of:

a. producing water to surface;

b. heating the produced water to less than the boiling point of the produced water to form a heated liquid water, wherein the heated liquid water temperature is selected to prevent failure of casing and cement of the well;

c. pumping the heated liquid water down the well to the heavy oil;

d. shutting in the well and allowing heat from the heated liquid water to reduce viscosity of the heavy oil;

e. allowing reservoir pressure to drive the reduced-viscosity heavy oil to the well; and f. opening the well and producing the reduced-viscosity heavy oil to the surface.

2. The method of claim 1 wherein the heavy oil is less than 20 degrees API gravity.

3. The method of claim 1 wherein the CHOPS well comprises at least one wormhole channel providing a permeability channel for movement of the reduced-viscosity heavy oil.

4. The method of claim 1 wherein reservoir pressure is sufficient to drive the producing of the reduced-viscosity heavy oil.

5. The method of claim 1 wherein the producing of the water to the surface is achieved through one or more offset wells.

6. The method of claim 1 wherein steps a. through f. are repeated.

7. The method of claim 1 wherein the step of heating the produced water comprises heating the produced water to about but not more than 99 degrees Celsius.

8. The method of claim 1 wherein the shutting in of the well is for a period of 10 to 14 days.

9. The method of claim 1 wherein a portion of the heated liquid water pumped down the well is produced to the surface and re-used for subsequent re-heating and re-injection.

10. A method for stimulating heavy oil recovery from a Cold Heavy Oil Production with Sand (CHOPS) well that is experiencing reduced production due to heavy oil viscosity but not water-out, the method comprising the steps of:

a. producing water to surface;

b. heating the produced water to less than the boiling point of the produced water to form a heated liquid water, wherein the heated liquid water temperature is selected to prevent failure of casing and cement of the well;

c. pumping the heated liquid water down the well to the heavy oil;

d. shutting in the well and allowing heat from the heated liquid water to reduce viscosity of the heavy oil;

e. allowing reservoir pressure to drive the reduced-viscosity heavy oil to the well; and f. opening the well and producing the reduced-viscosity heavy oil to the surface.

11. The method of claim 10 wherein the heavy oil is less than 20 degrees API gravity.

12. The method of claim 10 wherein the CHOPS well comprises at least one wormhole channel providing a permeability channel for movement of the reduced-viscosity heavy oil.

13. The method of claim 10 wherein reservoir pressure is sufficient to drive the producing of the reduced-viscosity heavy oil.

14. The method of claim 10 wherein the producing of the water to the surface is achieved through one or more offset wells.

15. The method of claim 10 wherein steps a. through f. are repeated.

16. The method of claim 10 wherein the step of heating the produced water comprises heating the produced water to about but not more than 99 degrees Celsius.

17. The method of claim 10 wherein the shutting in of the well is for a period of 10 to 14 days.

18. The method of claim 10 wherein a portion of the heated liquid water pumped down the well is produced to the surface and re-used for subsequent re-heating and re-injection.

19. A method for recovering heavy oil from a Cold Heavy Oil Production with Sand (CHOPS) well, where the well has not experienced water-out, the method comprising the steps of:

a. producing water to surface;

b. heating the produced water to less than the boiling point of the produced water to form a heated liquid water, wherein the heated liquid water temperature is selected to prevent failure of casing and cement of the well;

c. determining a volume of the heated liquid water required to increase the heavy oil temperature by a selected amount to reduce viscosity;

d. pumping the volume of the heated liquid water down the well to the heavy oil;

e. shutting in the well and allowing heat from the heated liquid water to reduce viscosity of the heavy oil;

f. allowing reservoir pressure to drive the reduced-viscosity heavy oil to the well; and g. opening the well and producing the reduced-viscosity heavy oil to the surface.

20. The method of claim 19 wherein the heavy oil is less than 20 degrees API gravity.

21. The method of claim 19 wherein the CHOPS well comprises at least one wormhole channel providing a permeability channel for movement of the reduced-viscosity heavy oil.

22. The method of claim 19 wherein reservoir pressure is sufficient to drive the producing of the reduced-viscosity heavy oil.

23. The method of claim 19 wherein the producing of the water to the surface is achieved through one or more offset wells.

24. The method of claim 19 wherein steps a. through g. are repeated.

25. The method of claim 19 wherein the step of heating the produced water comprises heating the produced water to about but not more than 99 degrees Celsius.

26. The method of claim 19 wherein the shutting in of the well is for a period of 10 to 14 days.

27. The method of claim 19 wherein a portion of the heated liquid water pumped down the well is produced to the surface and re-used for subsequent re-heating and re-injection.

28. The method of claim 19 wherein the volume of the heated liquid water is determined based on reservoir characteristics, nature and amount of the heavy oil being mobilized, subsurface pressure environment, and presence of wormhole channels.

29. The method of claim 19 wherein the selected amount of the heavy oil temperature increase depends on an initial viscosity of the heavy oil and downhole pressure environment.

30. The method of claim 19 wherein the selected amount of the heavy oil temperature increase is selected to achieve a selected target viscosity.

31. The method of claim 19 wherein the step of determining the volume of the heated liquid water is undertaken before the step of heating the produced water.

32. A method for stimulating heavy oil recovery from a Cold Heavy Oil Production with Sand (CHOPS) well that is experiencing reduced production due to heavy oil viscosity but not water-out, the method comprising the steps of:

a. producing water to surface;

b. heating the produced water to less than the boiling point of the produced water to form a heated liquid water, wherein the heated liquid water temperature is selected to prevent failure of casing and cement of the well;

c. determining a volume of the heated liquid water required to increase the heavy oil temperature by a selected amount to reduce viscosity;

d. pumping the volume of the heated liquid water down the well to the heavy oil;

e. shutting in the well and allowing heat from the heated liquid water to reduce viscosity of the heavy oil;

f. allowing reservoir pressure to drive the reduced-viscosity heavy oil to the well; and g. opening the well and producing the reduced-viscosity heavy oil to the surface.

33. The method of claim 32 wherein the heavy oil is less than 20 degrees API gravity.

34. The method of claim 32 wherein the CHOPS well comprises at least one wormhole channel providing a permeability channel for movement of the reduced-viscosity heavy oil.

35. The method of claim 32 wherein reservoir pressure is sufficient to drive the producing of the reduced-viscosity heavy oil.

36. The method of claim 32 wherein the producing of the water to the surface is achieved through one or more offset wells.

37. The method of claim 32 wherein steps a. through g. are repeated.

38. The method of claim 32 wherein the step of heating the produced water comprises heating the produced water to about but not more than 99 degrees Celsius.

39. The method of claim 32 wherein the shutting in of the well is for a period of 10 to 14 days.

40. The method of claim 32 wherein a portion of the heated liquid water pumped down the well is produced to the surface and re-used for subsequent re-heating and re-injection.

41. The method of claim 32 wherein the volume of the heated liquid water is determined based on reservoir characteristics, nature and amount of the heavy oil being mobilized, subsurface pressure environment, and presence of wormhole channels.

42. The method of claim 32 wherein the selected amount of the heavy oil temperature increase depends on an initial viscosity of the heavy oil and downhole pressure environment.

43. The method of claim 32 wherein the selected amount of the heavy oil temperature increase is selected to achieve a selected target viscosity.

44. The method of claim 32 wherein the step of determining the volume of the heated liquid water is undertaken before the step of heating the produced water.

* * * * *